US006429816B1

(12) United States Patent
Whybrew et al.

(10) Patent No.: US 6,429,816 B1
(45) Date of Patent: Aug. 6, 2002

(54) SPATIALLY ORTHOGONAL SIGNAL DISTRIBUTION AND SUPPORT ARCHITECTURE FOR MULTI-BEAM PHASED ARRAY ANTENNA

(75) Inventors: Walter M. Whybrew; Brett A. Pigon, both of Palm Bay; Gary Rief, Melbourne; Gregory M. Jandzio, Melbourne; Jay D. Warshowsky, Melbourne, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/849,111

(22) Filed: May 4, 2001

(51) Int. Cl.[7] ..... H01Q 1/38
(52) U.S. Cl. ..... 343/700 MS; 343/853
(58) Field of Search ..... 343/795, 700 MS, 343/853, 814; 342/368, 372, 375

(56) References Cited

U.S. PATENT DOCUMENTS

| | | | | |
|---|---|---|---|---|
| 4,374,368 A | | 2/1983 | Voila et al. | 333/128 |
| 4,424,500 A | | 1/1984 | Viola et al. | 333/128 |
| 4,472,691 A | | 9/1984 | Kumar et al. | 333/103 |
| 4,583,061 A | | 4/1986 | O'shea | 333/166 |
| 4,584,581 A | | 4/1986 | Teshirogi | 343/373 |
| 4,973,972 A | | 11/1990 | Huang | 343/700 MS |
| 5,065,165 A | | 11/1991 | Blaisdell | 343/753 |
| 5,093,668 A | | 3/1992 | Sreenivas | 342/374 |
| 5,166,690 A | | 11/1992 | Carlson et al. | 342/157 |
| 5,293,171 A | | 3/1994 | Cherrette | 343/700 MS |
| 5,455,594 A | | 10/1995 | Blasing et al. | 343/700 MS |
| 5,459,474 A | | 10/1995 | Mattioli et al. | 343/702 |
| 5,471,220 A | | 11/1995 | Hammers et al. | 342/372 |
| 5,512,906 A | | 4/1996 | Speciale | 342/375 |
| 5,539,415 A | | 7/1996 | Metzen et al. | 343/700 MS |
| 5,675,345 A | | 10/1997 | Pozgay et al. | 343/700 MS |
| 5,812,089 A | | 9/1998 | Locke | 342/373 |
| 5,835,057 A | | 11/1998 | Van Heyningen | 342/359 |
| 5,872,547 A | | 2/1999 | Martek | 343/815 |
| 6,127,981 A | * | 10/2000 | Pritchett et al. | 343/711 |
| 6,239,764 B1 | * | 5/2001 | Timofeev et al. | 343/795 |
| 6,266,015 B1 | * | 7/2001 | Heckaman et al. | 343/700 MS |

* cited by examiner

*Primary Examiner*—Don Wong
*Assistant Examiner*—James Clinger
(74) *Attorney, Agent, or Firm*—Allen, Dyer, Doppelt, Milbrath & Gilchrist, P.A.

(57) ABSTRACT

A multi-beam phased array antenna architecture includes a plurality of antenna modules, stacked together in a side-by-side relationship. Mutually adjacent edges of the modules have antenna elements that form a two-dimensional antenna array as a result of the stacking of the antenna modules. Opposite sides of an antenna module are tray-configured and contain amplifier modules coupled to the antenna elements, and to 'vertical' microstrip layers on undersides of double-sided printed wiring boards. Outersides of the double-sided printed wiring boards contain 'horizontal' microstrip layers, one for each beam, to which multiple beam-associated phase shift circuit elements for each antenna element on the module are ported. The phase shift circuit elements are also coupled by conductive vias to the first microstrip layers. The second microstrip layers are coupled to connectors along second edges of the modules for engagement with beam signal network modules.

28 Claims, 10 Drawing Sheets

SPATIALLY ORTHOGONAL SIGNAL DISTRIBUTION AND SUPPORT ARCHITECTURE FOR MULTI-BEAM PHASED ARRAY ANTENNA

FIELD OF THE INVENTION

The present invention relates in general to communication systems and components therefor, and is particularly directed to a new and improved phased array antenna architecture, formed by a stacked arrangement of tray-configured modules containing signal processing and routing networks having mutually orthogonal spatial configurations, that facilitate integrating all of the components of the antenna in a highly densified package, that not only reduces occupied volume, but provides for direct low loss ribbon bonding between signal components and microstrip conductors of associated signal distribution networks.

BACKGROUND OF THE INVENTION

Among desired characteristics of multi-element antenna systems (e.g., phased array antennas) of the type that may be deployed on a mobile platform, such as a satellite, are the requirement that the antenna be physically compact, while also being sufficiently broadband to meet performance requirements of terrestrial communication systems. Indeed, the on-going trend is towards deploying systems capable of producing multiple independent steerable beams operating at higher frequencies (such as those operating at 25–40 GHz and above). Although progress has been made in reducing the physical size and packaging density of the radiating elements, per se, the substantial physical space required to implement and mount their associated control networks and interconnection circuitry has effectively limited the size and packaging density of the total system.

This problem becomes acute in multi-beam applications, which require very high RF distribution, with each beam having its own set of beam steering and combining components installed behind a shared aperture. At Ka-band, for example, providing an interconnect architecture between the antenna's beam forming network and the antenna modules becomes a particularly daunting challenge, as a fully periodic wide scan multibeam array requires a very densely packed array of very small geometry antenna elements, for which a very large number of electrical connections are required.

SUMMARY OF THE INVENTION

Pursuant to the present invention, these requirements are satisfied by a new and improved, extremely compact, phased array antenna architecture used for very high frequency, multi-beam applications, that successfully integrates a plurality of closely spaced antenna elements of a generally planar spatial array with associated amplifier, phase shift and power divider and distribution networks, in a highly nested physical structure. As will be described, this highly nested structure relies upon the mutual orthogonality of the layout and configuration of each of its components, that enable it to enjoy a significantly reduced size and packaging density in contrast to prior art systems.

To this end, the multi-beam phased array antenna architecture of the invention is assembled by stacking together a plurality of relatively thin, generally flat or planar, tray-configured, multi-antenna element support and control modules. Mutually adjacent top edges of the modules of the stack contain sets or rows of plural antenna elements per row. The number of antenna elements in a given row and thereby the resulting two dimensional distribution for the stack is based upon the intended spatial geometry characteristics of the overall array. The modules are retained in side-by-side, edge-adjacent relationship by a generally rectangularly shaped frame, that also retains power supply and control electronics modules for the array.

Opposite sides of a support member for a respective antenna module are preferably mirror images of one another, each being configured as a generally rectangular tray-shaped structure. The top edge of the tray-shaped support member of a respective antenna module serves as a support surface for a portion of (e.g., two parallel rows of) the antenna elements of the phased array, and includes conductive, 'coaxial-like' vias for connecting the antenna elements installed in the two rows with associated electronic circuit components (e.g., antenna amplifier circuits) installed on opposite sides of the tray. A front edge of the tray, adjacent to the top edge, has a set of mesas, bores through which contain signal connectors configured to be interconnected or plugged with associated connectors of externally accessible signal combiner network modules, outputs of which are associated with respective beams of the multi-beam array.

Each side of a respective antenna module's generally rectangular tray-shaped structure is configured to accommodate power supply and control electronic circuit components. It also has a recessed floor region containing longitudinal depressions that extend in parallel along a first (e.g., 'vertical') direction from locations adjacent to the antenna amplifier modules of the device-mounting region. These longitudinal depressions are sized to accommodate respective ones of generally 'vertically' oriented microstrip layers on the 'underside' of a double-sided printed wiring board, as mounted in a face-down orientation against the recessed floor region.

The number of vertical microstrip traces along the underside of a double-sided printed wiring board corresponds to the maximum number of antenna elements that may be accommodated in a respective row on the top edge of the module. The outputs of the antenna amplifier modules are coupled (e.g., ribbon bonded) to (terminal end pads of) respective ones of the generally 'vertically' oriented microstrip layers, with the depressions in the tray providing electrical shielding for the vertical microstrip conductors.

The double-sided printed wiring board, which is a relatively low loss structure and facilitates interconnects, comprises a laminate of a ground plane (e.g., metallic) layer and a pair of 'underside' and 'topside' dielectric layers containing patterned mutually orthogonal or 'horizontal' microstrip layers. The topside dielectric layer is patterned into parallel 'horizontal' stripe-shaped sections, on which 'horizontal' microstrip layers extend in a direction orthogonal to the 'vertical' microstrip layers on the underside of the double-sided printed wiring board. The number of horizontal microstrip layers on the topside of the double-sided printed wiring board corresponds to the number of beams formed by the multi-beam phased array antenna.

Since each of the antenna elements on the top edges of the stacked modules is associated with the generation of each of the multi-beams of the phased array, it is necessary to provide a respective phase shifter—per antenna element—per beam. For this purpose, the double-sided printed wiring board contains conductive vias, which connect plural signal distribution (power divider) locations (corresponding to the number of beams) along the vertical microstrip layers on the underside of the board to locations for effecting connections to respectively associated phase shift modules installed in module mounting regions adjacent to the horizontal microstrip layers on the topside of the double-sided printed wiring board.

For this purpose, the stripe-shaped sections of dielectric, on which the horizontal microstrip layers are distributed, are spaced apart by phase shifter module-mounting regions that are sized to accommodate placement of the phase shift modules, so that their terminal pads are immediately adjacent to the connection vias and phase shifter module connection locations of the horizontal microstrip layers. This immediate proximity of terminal pads of the microstrip layers and electronic components and conductive vias of the orthogonally arranged microstrip layers of the printed wiring boards facilitates interconnections thereamong by the use of ribbon bonding, applied by robotically controlled equipment, and enables them to be impedance-matched at the very high operational frequencies of the antenna array.

The horizontal microstrip layers on the topside of the double-sided printed wiring board terminate at connection pads immediately adjacent to (module-installed) associated beam amplifier circuits mounted adjacent to the front edge of the board. The output of a respective beam's amplifier circuit for each antenna module is coupled to an amplifier module connector installed in an associated one of the mesas at the front edge of the antenna module. These amplifier module connectors are connected, in turn, with respective beam-associated aconnectors of signal combiner network modules distributed along the front edges of the antenna modules as stacked in the support frame.

Each signal combiner network module contains input connector ports aligned with the connectors in the mesas of the plural antenna modules of the stack. The input connector ports are internally terminated to respective terminal pad locations of adjacent microstrip-configured, beam signal combiners, one for each of the beams of the multibeam array, so that a respective signal combiner of a beam signal combiner network module sums the contribution of each row of antenna elements of each antenna module across the entire stack for a given beam. Respective summing ends of the signal combiners are connected to associated summing amplifier modules, outputs of which are ported to beam terminal connectors, each of which is associated with a respectively different beam of the multi-beam array.

DETAILED DESCRIPTION

Figure 1:
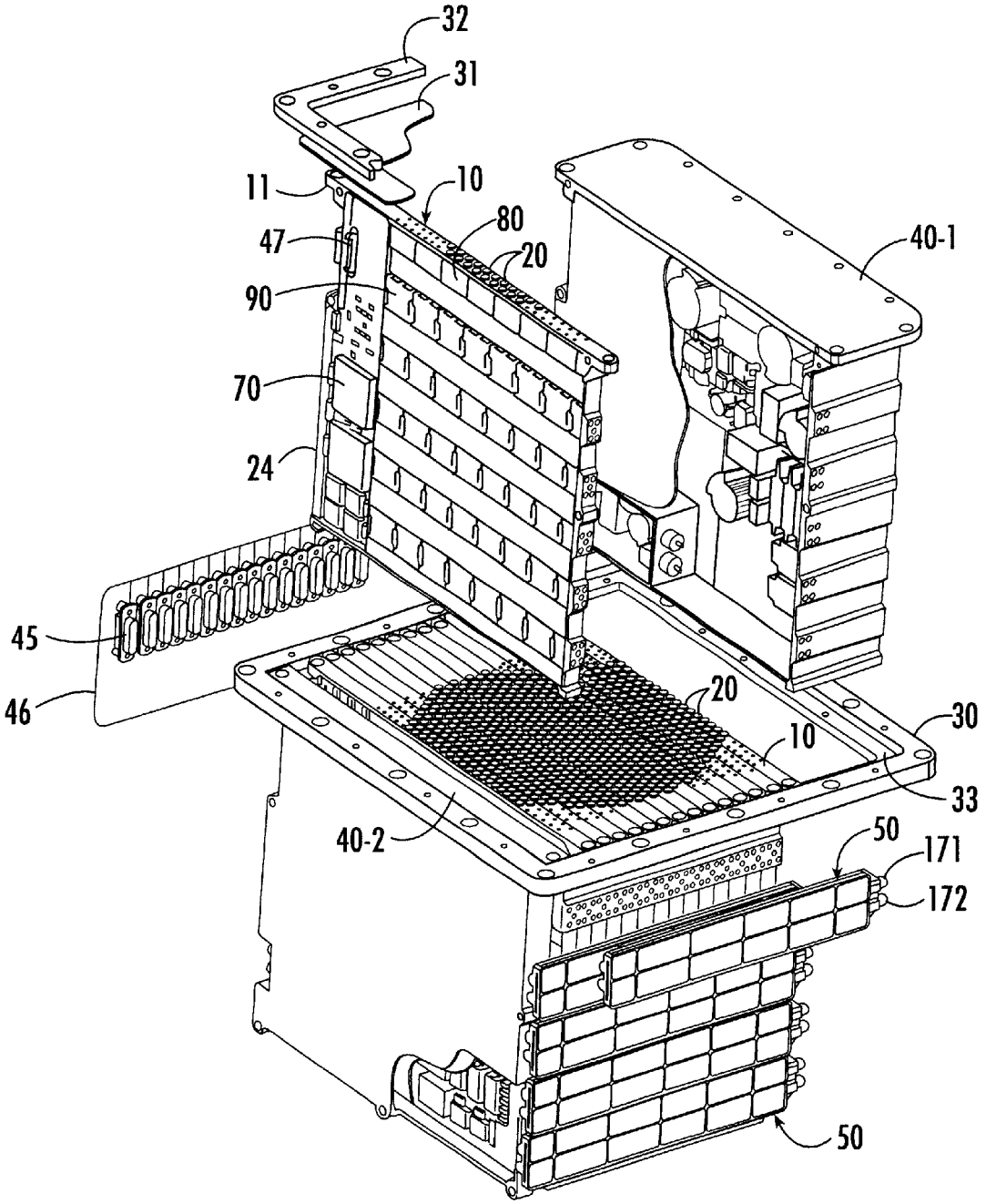
FIG. 1 is a partially exploded perspective view of the architecture of the phased array antenna of the present invention.
Figure 2:
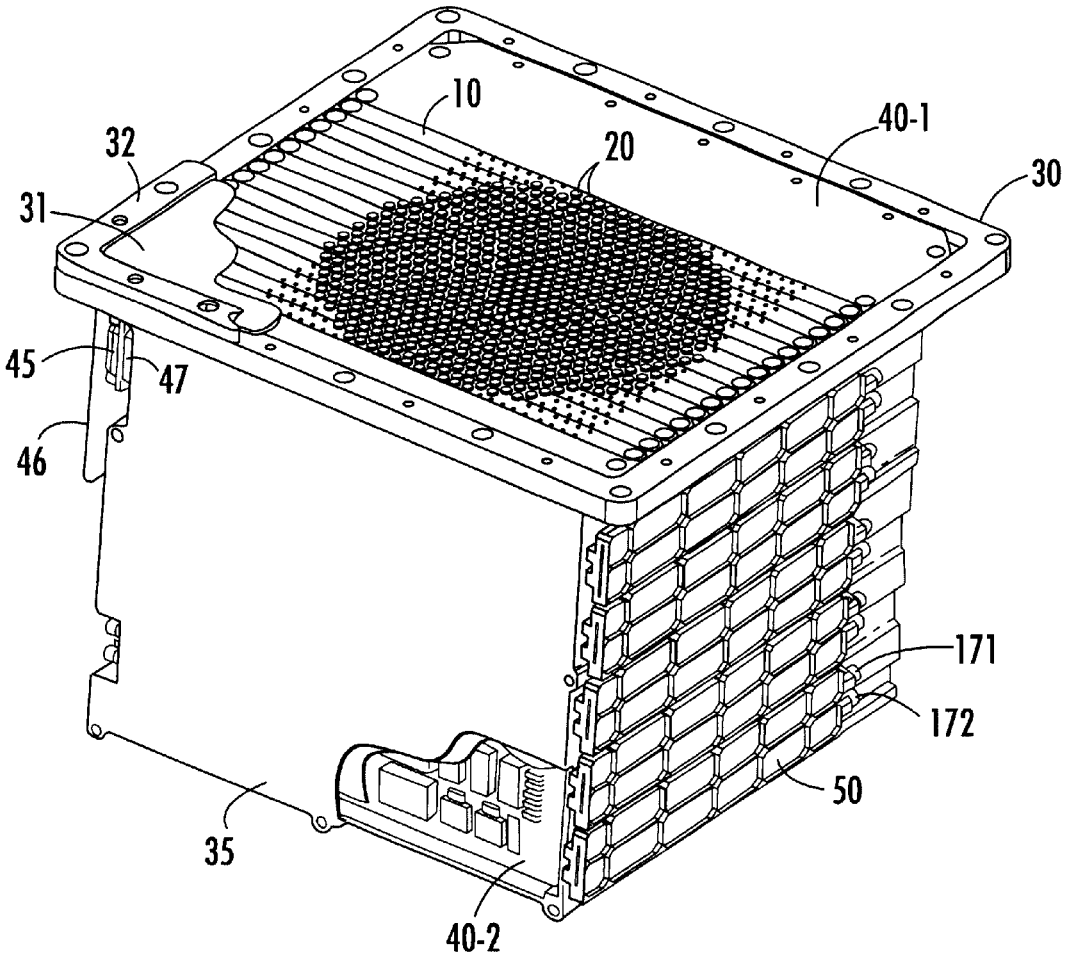
FIG. 2 is an assembled perspective view of the architecture of the phased array antenna of FIG. 1.

Attention is initially directed to FIGS. 1 and 2, which are respective partially exploded and assembled perspective views of the overall architecture of the multi-beam, phased array antenna of the present invention. For purposes of providing a non-limiting example, the invention will be described for the case of a ten beam phased array receiver application. It should be observed, however, that the invention is not limited to this or any particular number, nor is the invention limited to only a receiver application; it may also be employed in a transmitter application. In the latter instance, the direction of signal flow and components associated with that signal flow are reversed (signal combiner circuits being used in place of signal division circuits, and vice versa). The ten beam receiver application example described here serves to illustrate the very practical utility of the orthogonal structure of the invention in packaging a multi-beam phased array receiver antenna in a very confined physical volume.

As shown therein, the antenna array itself is formed of a plurality of generally flat/planar or card-shaped, tray-configured, multi-antenna element support and control antenna modules 10, upon common, mutually adjacent top edges of which a plurality of antenna elements 20 are supported in accordance with the intended spatial configuration of the overall array. The antenna modules 10 are individually insertable into and supported by a generally rectangularly shaped housing frame 30. Environmental protection for the components installed in the frame 30 may be provided by way of a topside cover (radome) 31, made of a material such as a plastic that is transparent to the RF energy of the array, and which is secured to the frame 30 by means of an annular collar 32, as well as side covers, one of which is shown partially at 35.

The antenna modules 10 are readily retained in a side-by-side, 'stacked' configuration, by affixing opposite flange regions 11 thereof to an annular lip portion 33 of the frame 30. In addition to supporting such stacked antenna modules 10, the frame 30 is sized to accommodate and retain one or more additional power supply and control electronics modules, such as the respective modules shown at 40-1 and 40-2, which are insertable into and supportable by the frame 30 along opposite sides of the stack of antenna modules 10.

Figure 3:
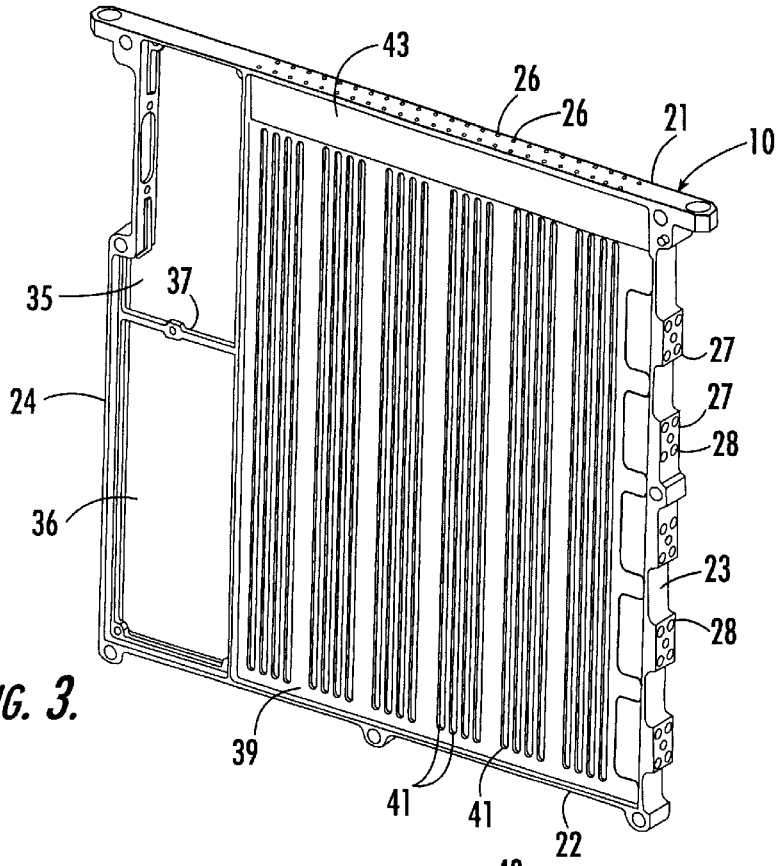
FIG. 3 is a perspective view of a first side of the support structure of an antenna module of the phased array antenna architecture of the invention.
Figure 4:
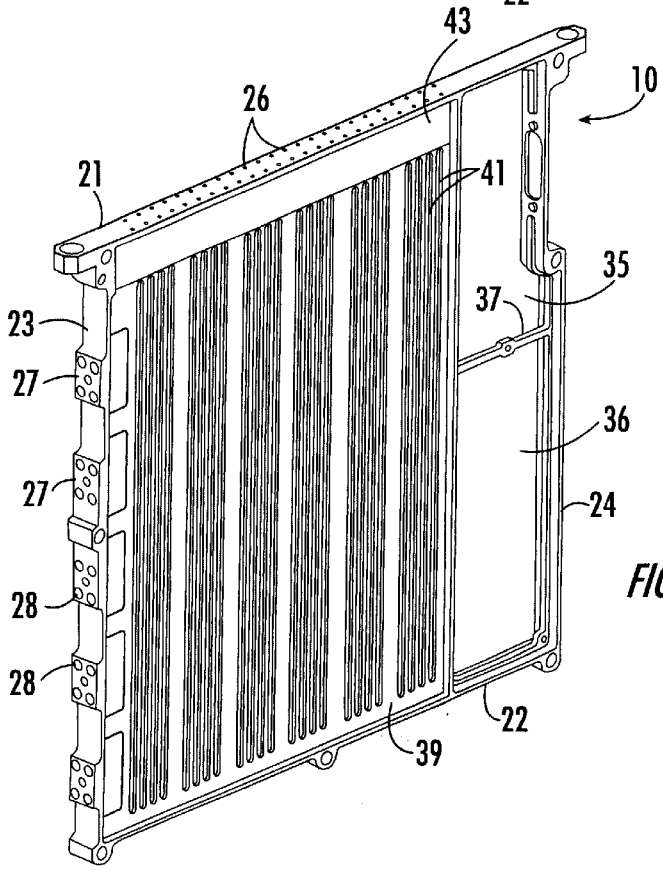
FIG. 4 is a perspective view of a second, opposite side of the antenna module support structure of FIG. 3.

FIGS. 3 and 4 are respective perspective views of opposite 'mirror image' sides of the underlying support structure of a respective antenna module 10, upon which the antenna elements 20, as well as modules containing control circuits and interconnect therefor, are mounted. The underlying support member or 'base' of a respective antenna module 10 is made of an electrically and thermally conductive, structurally rigid material (e.g. a metal, such as aluminum or aluminum beryllium). Each side of the module/base is configured as a generally rectangular tray-shaped structure, that is bounded by first and second opposite, generally parallel, edges 21 and 22 (corresponding respective top and bottom edges as viewed in the Figures), and third and fourth, generally parallel opposite edges 23 and 24 (respective front and rear edges as viewed in the Figures), that are generally orthogonal to the edges 21 and 22.

The antenna module's top edge 21 serves as a support surface for two rows of some number of antenna elements 20 of the phased array (as shown in FIGS. 1 and 2, referenced above). As a non-limiting example, the illustrated embodiment provides for the installation of up to twenty-four elements per row, so that up to forty-eight antenna elements may be mounted to the top edge 12 of a respective module. It will be understood that the number of antenna elements per row can be expected to potentially vary from row to row and module to module (as shown for example in the arrays depicted in FIGS. 1 and 2), depending upon the intended two-dimensional spatial geometry of the overall array.

Figure 11:
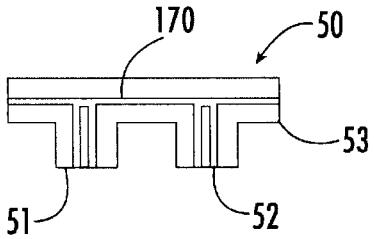
FIG. 11 is an end view of a respective signal combiner network module that is connectable to the mesa ports of multiple antenna modules of the phased array architecture of FIGS. 1 and 2.
Figure 12:
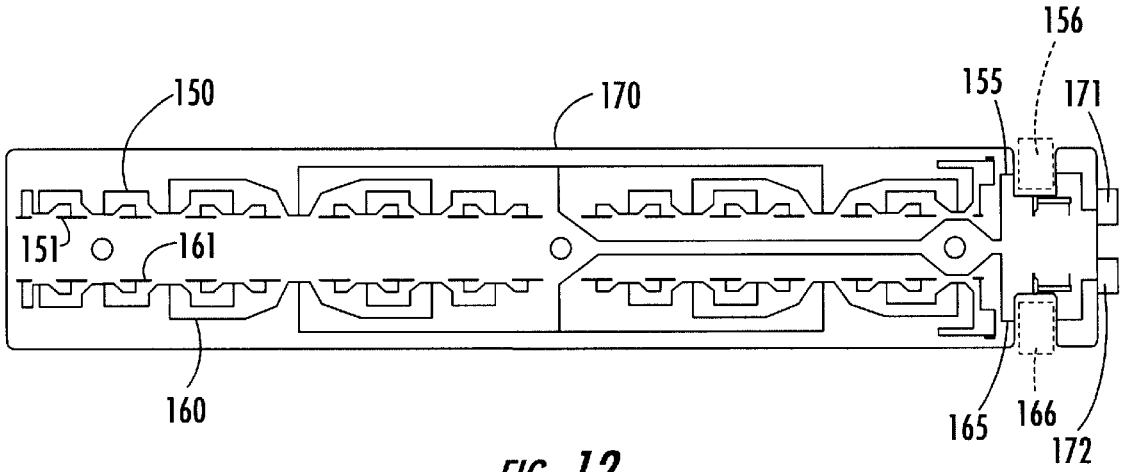
FIG. 12 is a plan view of the microstrip combiner layout of the signal combiner network module of FIG. 11.

The top edge 21 of a respective antenna module includes associated vias 26 through which connections between the antenna elements 20 and associated electronic circuit components (antenna amplifier circuits) supported on opposite sides of the antenna module are made. To facilitate physical interconnection between signal lines associated with each beam across all of the antenna modules of the stack and respective dual beam signal combiner network modules (shown generally at 50 in FIGS. 1 and 2, and described in detail below with reference to FIGS. 11 and 12), the module's front edge 23 contains a plurality of mesas 27, each of which contains a set (two pairs) of connector bores 28 through which signal connections are made to the signal combiner network modules for two rows of antenna elements for two individual beams.

As shown in detail in FIG. 3 and FIG. 4, a respective side of an antenna module 10 contains a recessed floor region 39, that is formed between the third or front edge 23 and an interior wall 34, that extends between the respective upper and lower edges 21 and 22 of the antenna module. An antenna module further includes a pair of cut-out areas 35 and 36, which are separated from one another by a structural support spar 37, that extends between the rear edge 24 and the interior wall 34 of the module, and are sized to accommodate a number of power supply and control electronic circuit components employed by the module, such as shown generally at 70 in the perspective views of FIGS. 1 and 5. External electrical access to these electronic circuit components of the antenna modules may be provided by way of a set of connectors 45 installed along a rear closure plate or printed wiring board 46, which engage associated connectors 47 adjacent to the rear edges 24 of the modules, as shown in the perspective views of FIGS. 1, 2, 3, 4 and 5 and the side view of FIG. 10, to be described.

An antenna module's floor region 39 contains a plurality of generally longitudinal troughs, cavities or depressions 41. These cavities are parallel to the front edge 23 of the module and extend from a location adjacent to the bottom edge 22 of the module to a location spaced apart from the top edge 21, leaving a generally flat, device-mounting region 43 adjacent to the top edge 21 of the module. The device-mounting region 43 is sized to accommodate placement of a plurality of antenna element amplifier circuit modules (shown at 80 in FIGS. 1 and 5) that are mountable between the antenna elements 20 distributed along the top edge 21 of the module and terminating ends of respective ones of a set of 'vertical' microstrip conductors on the 'underside' of a respective double-sided printed wiring board, as will be described.

For the present example of a phased array having up to twenty-four antenna elements per row, six amplifier circuit modules 80 containing four individual amplifiers may be installed in the device mounting region 43. The longitudinal depressions 41 are aligned with and are sized and arranged to provide electrical shielding for these vertical microstrip conductors (shown at 65 in FIG. 6) that extend on the bottom side of an associated double-sided microstrip printed wiring board (shown at 60 in FIGS. 6 and 7 to be described below), when the printed wiring board 60 is mounted in face-to-face abutment with the module's floor region 39.

Figure 3A:
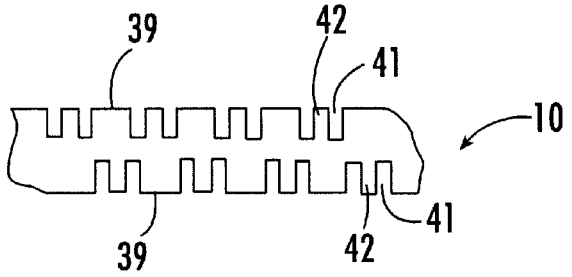
FIG. 3A is a diagrammatic partial side sectional view of the antenna module support structure of FIGS. 3 and 4, showing support posts within longitudinal cavities thereof.
Figure 4A:
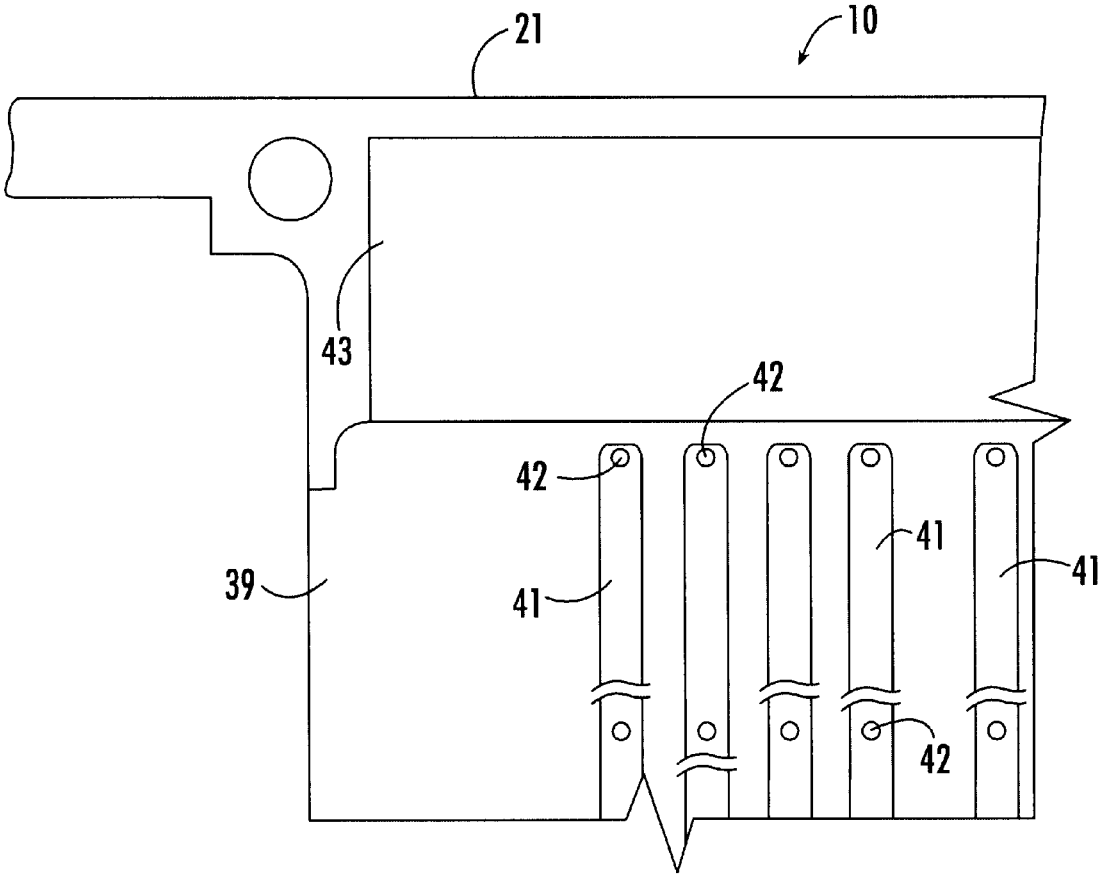
FIG. 4A is a diagrammatic partial plan view of the antenna module support structure of FIGS. 3 and 4, showing support posts within longitudinal cavities thereof.

As further depicted in the diagrammatic partial side sectional view of FIG. 3A and the partial plan view of FIG. 4A, the cavities 41 may contain optional distributions of support posts 42 that extend from the bottoms of the cavities up to the level of the floor region 39. In addition to the floor region 39 proper, the support posts 42 provide mechanical support for those portions of a printed wiring board that overlie the cavities 41. As such, the support posts 42 serve to prevent a wire bonding tool from deflecting the double-sided microstrip printed wiring board 60 downwardly into a cavity 41, thereby avoiding structural damage to the assembly, in the course of the bonding tool engaging a printed wiring board placed against a module's floor region 39.

Figure 6:
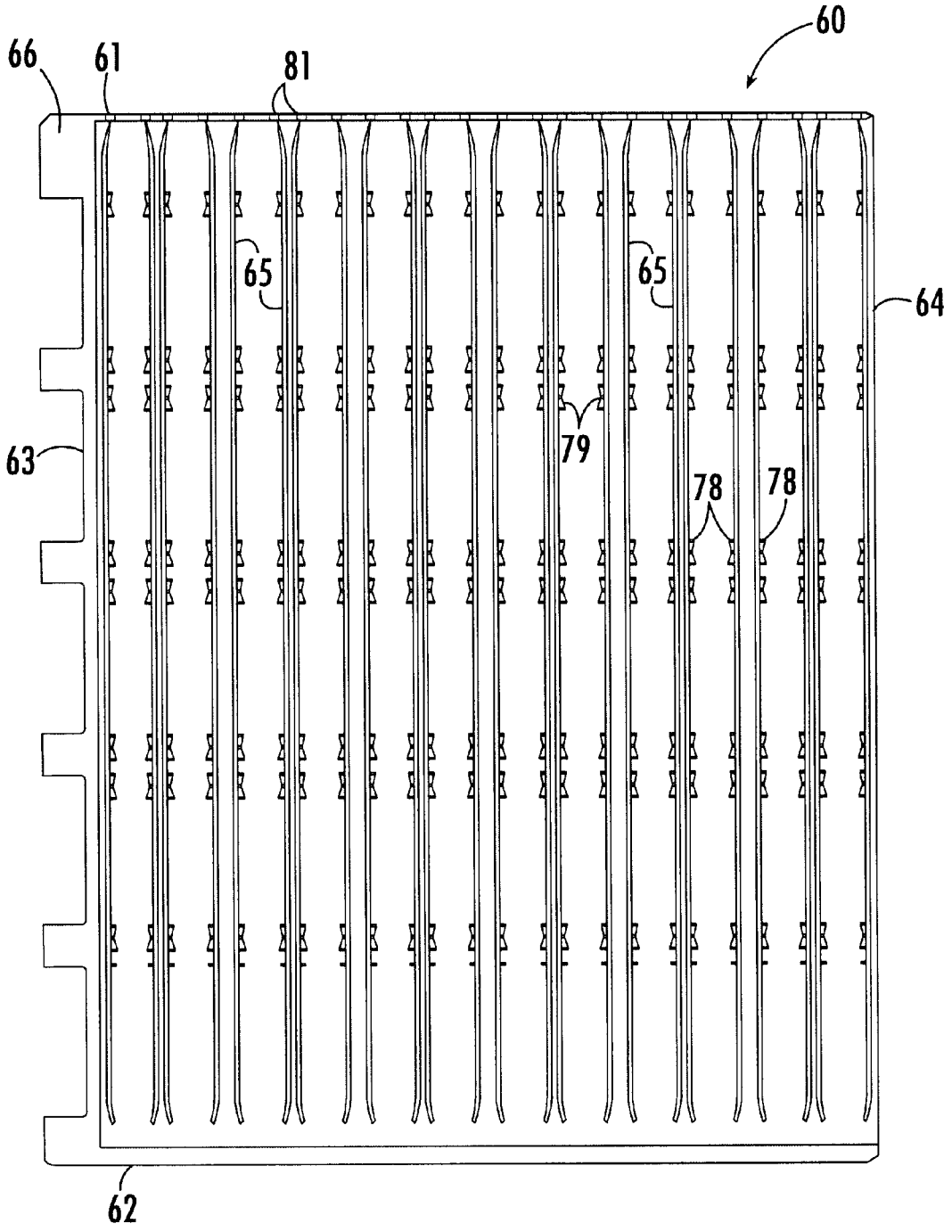
FIG. 6 is an underside view of a double-sided printed wiring board of a respective antenna module of the phased array architecture of FIGS. 1 and 2.
Figure 7:
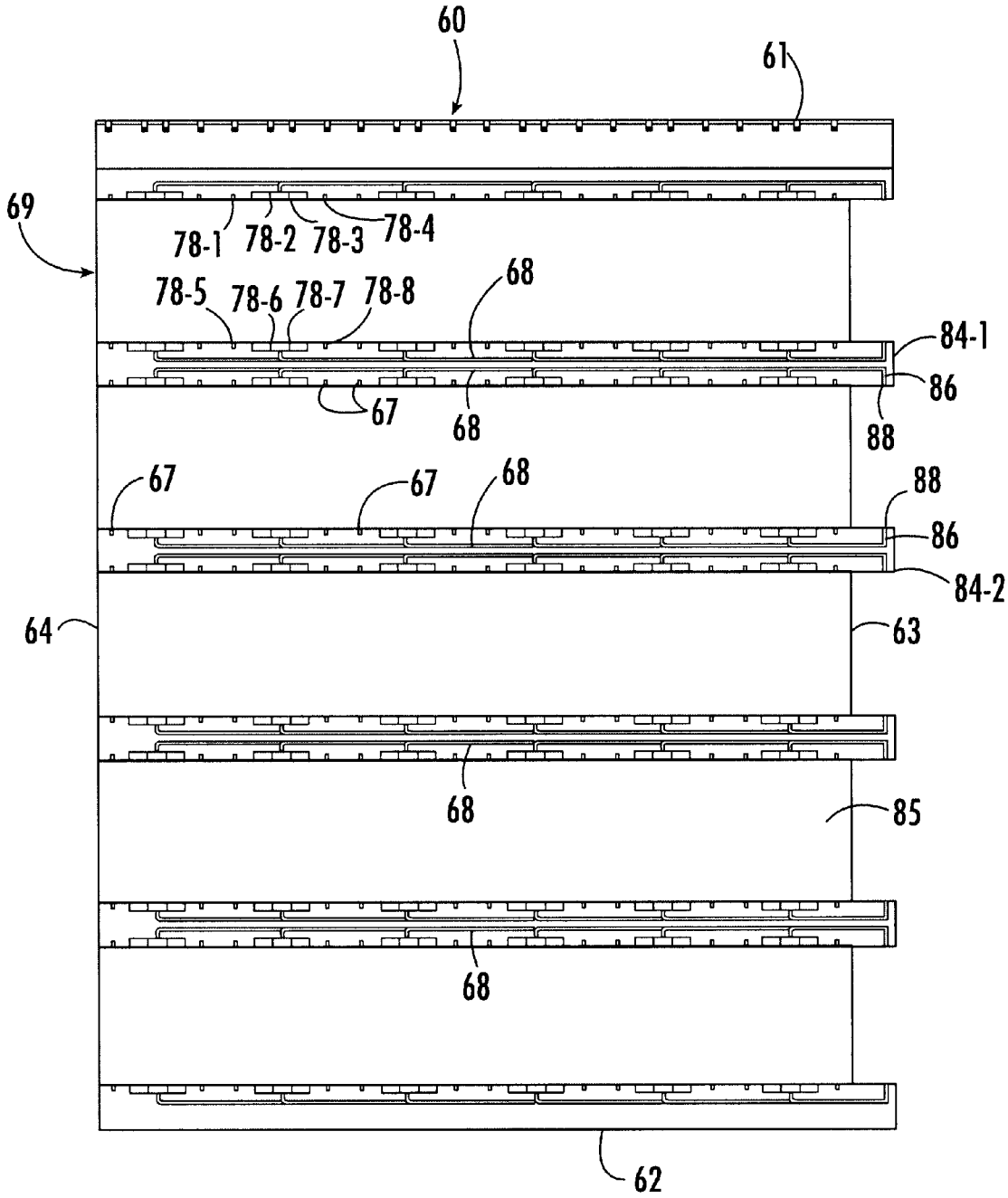
FIG. 7 is a topside view of a double-sided printed wiring board of a respective antenna module of the phased array architecture of FIGS. 1 and 2.

FIGS. 6 and 7 are respective 'underside' and 'topside' views of an individual double-sided microstrip printed wiring board 60. As shown therein, the wiring board may have a generally rectangular configuration that conforms with the floor region 39 of the module, so that it may be placed in a face-to-face abutment with the floor region (and against any support posts formed in the longitudinal cavities, as described above). The printed wiring board 60 is bounded by first and second opposite, generally parallel, edges 61 and 62 (respective top and bottom edges as viewed in the Figures), and third and fourth, that are generally parallel opposite edges 63 and 64 (respective front and rear edges as viewed in the Figures), and are generally orthogonal to board edges 61 and 62.

Figure 8:
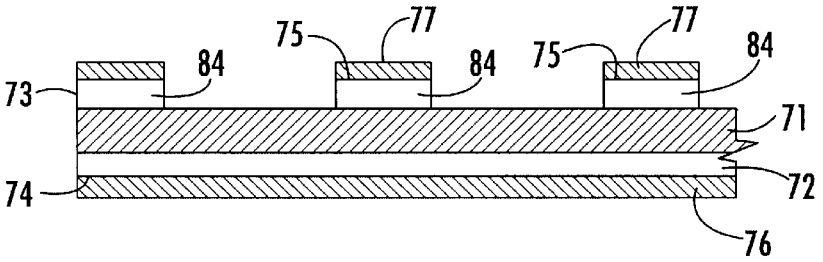
FIG. 8 is a diagrammatic cross-sectional view of the laminate structure of a respective printed wiring board.

As further illustrated in the diagrammatic cross-sectional view of FIG. 8, a respective double-sided printed wiring board 60 has a laminate configuration, containing a generally planar or flat central layer 71 of conductive material (e.g., copper), that serves as a ground plane and structural support for the board. A dielectric (e.g., Duroid) layer 72 is bonded to the underside of the layer 71, and a dielectric layer 73 that is patterned into a plurality of stripe-shaped sections 84 is bonded to the topside of the ground plane layer 71. The outer surfaces 74 and 75 of the dielectric layers 72 and 73 contain respective conductive layers 76 and 77, that are patterned into respective sets of 'vertical' (signal distributing) microstrip conductor layers 65 and 'horizontal' (signal combiner-configured) microstrip conductor layers 68.

Namely, the two sets of microstrip conductor layers 65 and 68 extend in directions that are generally mutually orthogonal to one another on the opposite sides of the double-sided printed wiring board 60. The board 60 also contains a plurality of conductive vias 78, through which connections are made between various signal distribution (power divider) locations 79 along the vertical microstrip layers 65 on the underside 66 of the board 60 shown in FIG. 6, and module connection locations 67 adjacent to the signal combining horizontal microstrip layers 68 on the topside 69 of the board 60, shown in FIG. 7.

As depicted in the underside view of a printed wiring board in FIG. 6, the vertical microstrip layers 65 are formed as generally parallel microstrip conductors extending in a direction ('vertical' as viewed in FIG. 7) that is generally orthogonal to, and terminating at conductive pads 81 along the top edge 61 of the board 60. The conductive pads 81 are aligned with adjacent signal connection pads of the antenna amplifier circuit modules distributed on the generally flat, device-mounting region 43. For the present example of twenty-four antenna elements per row, the underside of the double-sided printed wiring board may contain twenty-four vertical microstrip layers 65 associated conductive pads 81 of which are connected to the amplifier outputs of their associated twenty-four amplifier circuit modules 80.

Each longitudinally configured 'vertical' microstrip layer 65 also contains a plurality of spaced apart signal/power dividers 83, which are connected through the conductive vias 78 to signal connection locations along the spaced apart horizontal microstrip layers 68 on the topside of the double-sided printed wiring board, as shown in the topside view of FIG. 7. For the present example of a ten beam, twenty-four antenna element per row phased array, each of the twenty-four microstrip layers 65 on the underside of the board 60 has a distribution of ten power dividers 83 along its length coupled through associated conductive vias to locations adjacent ten microstrip layers 68 on the topside of the board.

FIG. 7 shows a plurality of (signal combining) microstrip layers 68 extending horizontally along the spaced apart stripe-shaped sections on the topside 69 of the double-sided printed wiring board 60 as individual or generally parallel, adjacent spaced apart sets (typically pairs) of microstrip conductors along a respective stripe. For the present example of a ten beam phased array application, the topside 69 of a respective double-sided printed wiring board 60 will contain ten horizontal microstrip conductors—one for each individual beam. In FIG. 7, the uppermost and lowermost stripes contain individual horizontal microstrip conductor traces 68, while each of the remaining four stripe-shaped sections therebetween contains a pair of horizonal microstrip conductors (for a total of ten), arranged to adjoin adjacent sets of phase shift modules (shown at 90 in FIGS. 1 and 5) used to control the ten beams of the phased array antenna.

As noted above, the microstrip layers 68 extend in a direction (horizontal as viewed in FIG. 7) that is generally parallel to the top edge 61 of the double-sided printed wiring board 60, and spatially orthogonal to the (generally vertical) direction of the microstrip layers 65 on the underside of the printed wiring board 60. The stripe-shaped sections of dielectric, along which the microstrip layers 68 are distributed (individually or in pairs, as described above), are spaced apart from one another by module-mounting regions 85 of the ground plane layer 71.

Figure 9:
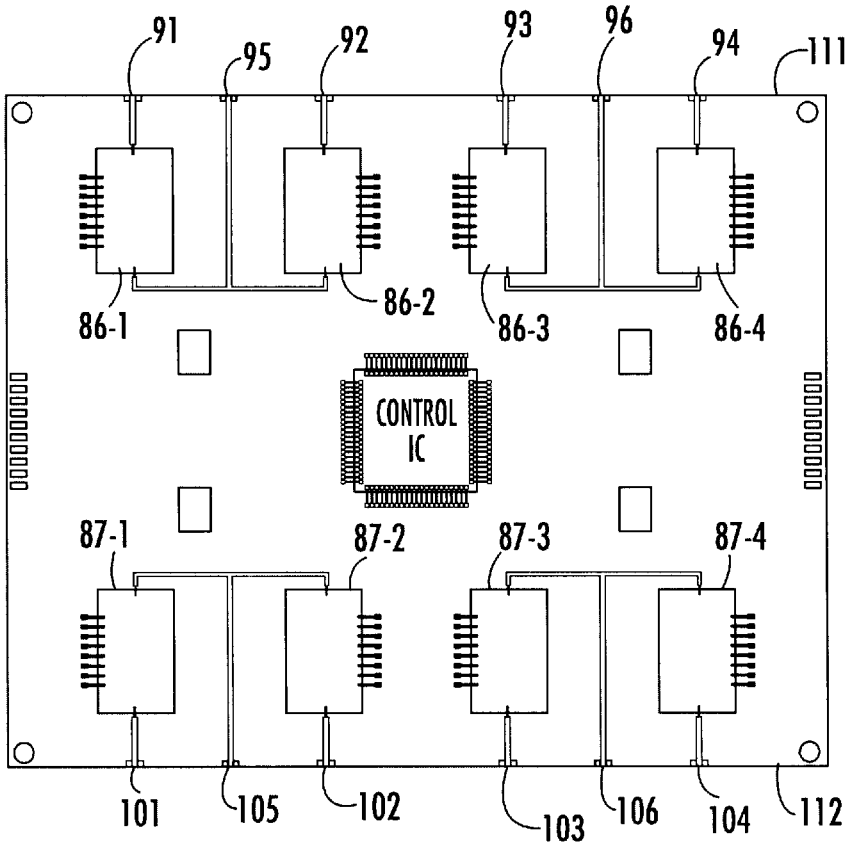
FIG. 9 diagrammatically illustrates the layout of a respective phase shift module mountable to the topside of a double-sided printed wiring board of a respective antenna module of the phased array architecture of FIGS. 1 and 2.

The module mounting regions 85 are sized to accommodate therebetween the placement of a plurality of phase shifter modules 90, each of which contains a plurality of phase shifter circuits (e.g., two sets of four for a total of eight per module, as shown in FIG. 9, described below), so that input pads of the phase shifter modules are immediately adjacent to connection vias 78 from the signal/power dividers of the (twenty-four) vertical microstrip traces 65 on the underside of the board, and such that the output terminal pads of the modules are immediately adjacent to connection locations 67 of the microstrip layers 68. This readily facilitates the use of ribbon bonding between the connection locations 67 and terminal pads of the modules.

Figure 10:
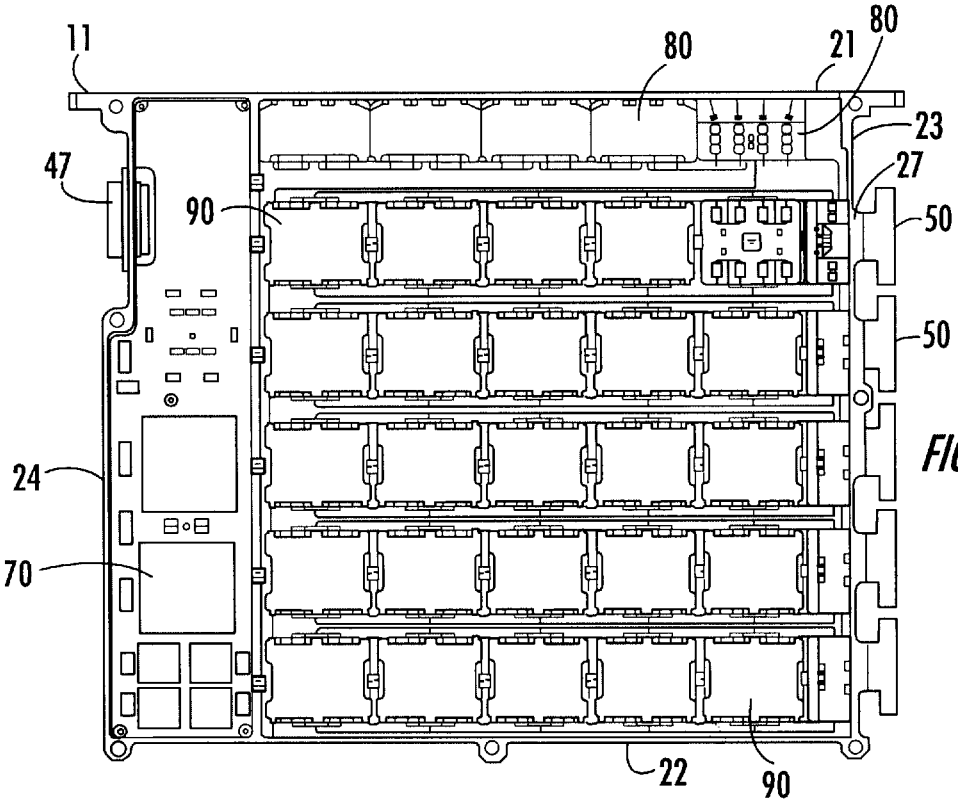
FIG. 10 is a side view of an antenna module of the phased array architecture of FIGS. 1 and 2.

More particularly, as diagrammatically illustrated in FIG. 9, which depicts the layout of a respective phase shift module 90, and FIG. 10, which is a side view of an antenna module 10, a respective multi phase shift circuit-containing module 90 may contain two sets of four phase shift elements 86-1, 86-2, 86-3, 86-4, and 87-1, 87-2, 87-3, 87-4. These respective sets of phase shift elements have associated sets of input terminal pads 91, 92, 93 and 94 and 101, 102, 103 and 104, and summing output terminal pads 95 and 96, and summing 105 and 106 distributed along opposite edges 111 and 112 thereof. The input terminal pads 91, 92, 93, 94 along one edge of a phase shift module are immediately adjacent to respective connection vias 78-1, 78-2, 78-3 and 78-4, along a stripe-shaped dielectric section 84-1, from the vertical microstrip layers 65 on the underside of the board. The input terminal pads 101, 102, 103, 104 along the other side of the phase shift module are immediately adjacent to respective connection vias 78-5, 78-6, 78-6 and 78-8 for a microstrip layer 68 an adjacent dielectric stripe 84-2.

In a like manner, the summing output terminal pads 95 and 96 of the four phase shift elements 86-1, 86-2 and 86-3, 86-4 of the multi phase shift element-containing module 80 are immediately adjacent to respective terminal pads 125 and 126 of the microstrip layer 68 on the dielectric stripe 84-1, while the summing output terminal pads 105 and 106 of the four phase shift elements 87-1, 87-2 and 87-3, 87-4 are immediately adjacent to respective terminal pads 135 and 136 of the microstrip layer 68 on the adjacent dielectric stripe 84-2. As noted previously, this immediate proximity of the various terminal pads of the microstrip layers and electronic components and conductive vias of the orthogonally configured architecture of the invention not only facilitates ribbon bond interconnections thereamong through the use of robotically controlled ribbon bonding equipment, but enables the interconnect bonds to comply with the requisite impedance matching parameters at the very high operational frequencies of the antenna array.

Figure 5:
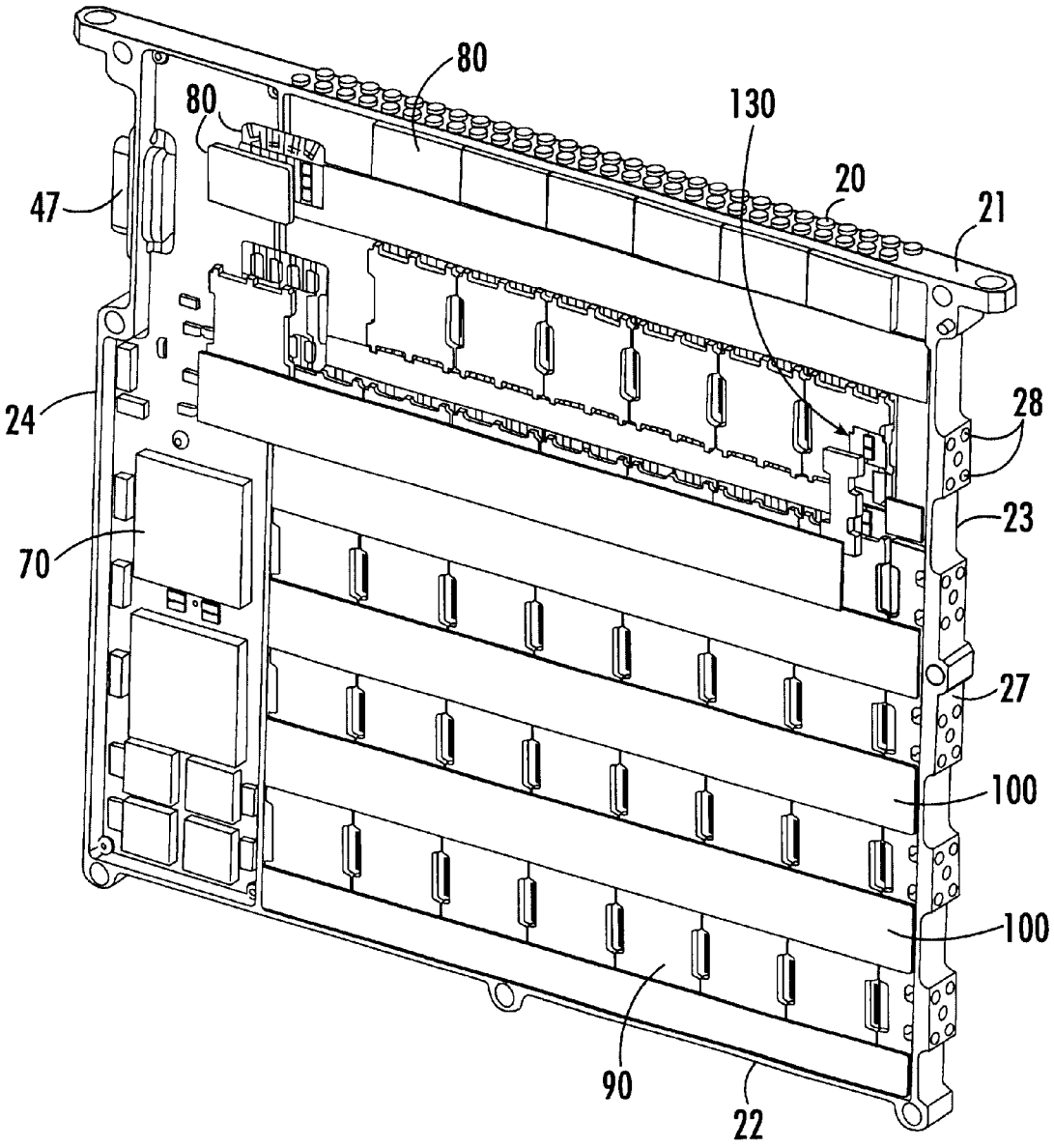
FIG. 5 is a perspective view of an antenna module of the phased array architecture of FIGS. 1 and 2.

The perspective view of FIG. 5 and the side view of FIG. 10 show the signal combining microstrip layers 68 that extend along the stripe-shaped dielectric sections 84 on the topside of a respective double-sided printed wiring board having distal ends 86 thereof terminating at connection pads 88, which are immediately adjacent to amplifier modules 130 mounted in those portions of the module-mounting regions 85 adjacent to the front edge 23 of an antenna module 10. The outputs of the amplifier modules 130 are coupled, in turn, to associated connectors installed in the connector bores 28 through the mesas 27 at the front edges 23 of the antenna module.

FIG. 5 also shows a set of protective covers 100, made of thermally and electrically conductive material (e.g. aluminum, and the like) that are configured to be attached to edge surfaces of the phase shift modules 90, and thereby provide protective shields for the runs of microstrip 68 therebeneath. Where a respective cover overlies a pair of microstrip layers 68 that extend along a stripe-shaped dielectric sections 84, the interior surface of the cover (facing the microstrip) may be provided with wall or ridge that extends down the middle of the cover and has a height that terminates at the surface of the dielectric (and may include vias to ground), thereby providing EMI isolation between the two adjacent microstrip layers 68 beneath the cover 100.

As described above, in order to facilitate interconnections between signal lines associated with each beam for all of the rows of antenna elements of the stack and respective signal combiner network modules for each of those beams, the amplifier module connectors installed in the connector bores 28 of the antenna modules 10 are connectable with associated connectors of the dual beam signal combiner network modules 50 distributed along the front edges 23 of the modules as stacked in the housing frame 20. For this purpose, as shown diagrammatically in the perspective views of FIGS. 1 and 2, the side view of FIG. 10, and the end view of FIG. 11, a respective dual beam signal combiner network module 50 has a generally T-shaped housing containing two rows of input connector ports 51 and 52, that extend or project generally orthogonally from a bottom surface 53 thereof, so as to allow an individual dual beam signal combiner network module 50 to be connected to output ports of multiple antenna modules 10 installed in a stacked fashion within the housing frame 20.

The input connector ports 51 and 52 are aligned with the connectors installed in the connector bores 28 of mesas 27 of multiple antenna modules 10. As illustrated in the plan view of FIG. 12, the input connector ports are internally terminated to respective terminal pad locations 151 and 161 of two adjacent sets of microstrip signal combiner traces 150 and 160 (associated with a respective pair of beams) of a printed wiring board 170 installed in the dual beam module 50. Namely, each dual beam combiner network module 50 sums the contribution of all of the antenna elements of each antenna module across the entire stack for a respectively different pair of beams. Respective summing ends 155 and 165 of the pair of beam signal combiner traces 150 and 160 of a respective dual beam module 50 are adapted to be connected to associated output amplifier modules (shown in broken lines 156 and 166), having their outputs ported to terminal end connectors 171 and 172 installed at distal ends of the modules 50.

Figure 13:
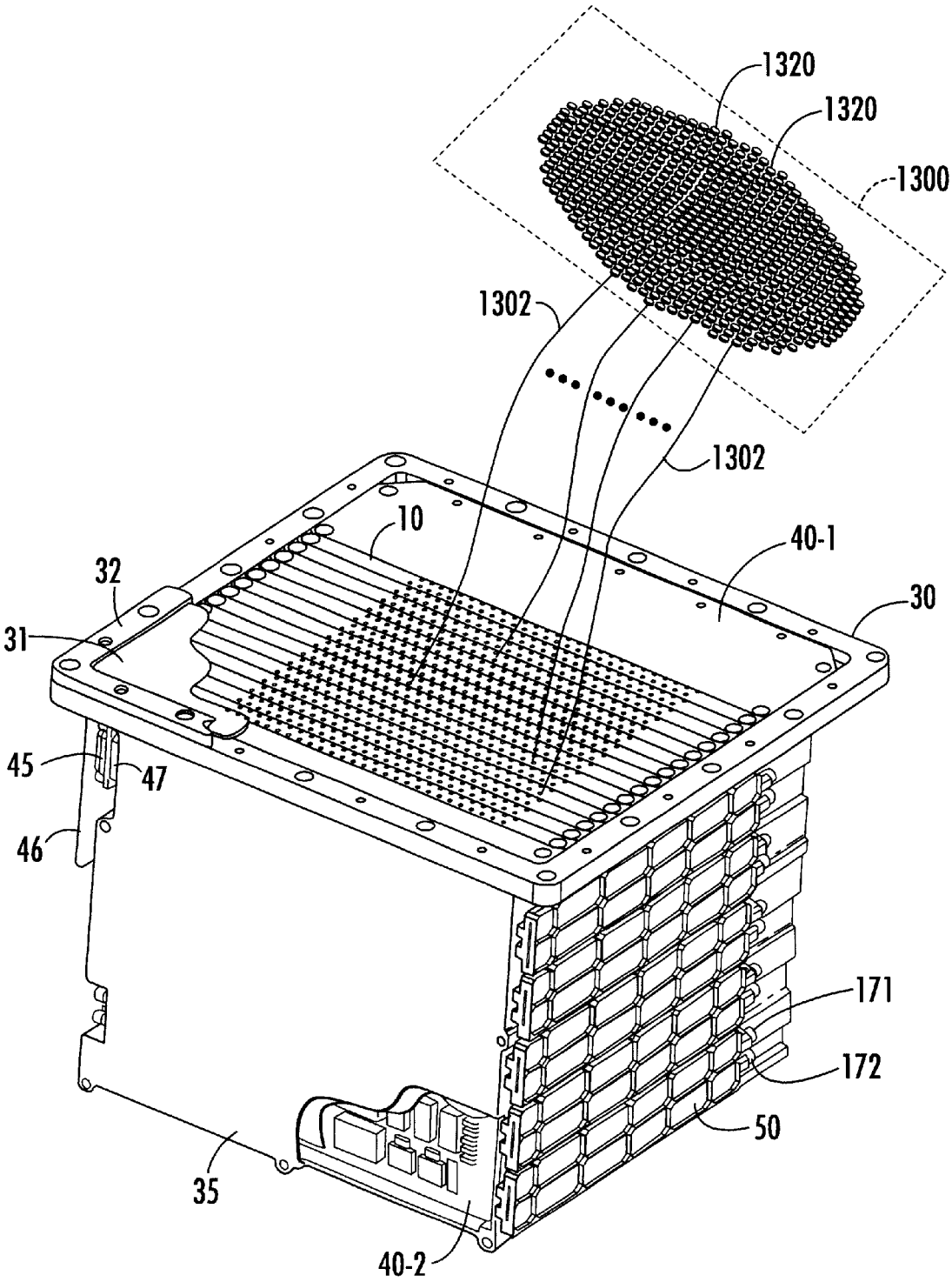
FIG. 13 is perspective view of a modified embodiment of the architecture of the phased array antenna of FIG. 1.

FIG. 13 shows a further embodiment of the invention, in which antenna elements 1320, rather than being insertable into and supported by the housing frame 30, are supported by an external structure 1300 and connected to the modules 10 within the housing frame 30 by means of associated cables 1302 (only a limited number of which are shown, to avoid cluttering the drawings). A benefit of this embodiment is that it allows the output of any control electronics module within any of the modules 10 to be fed to any antenna element 1320 of the external array 1300.

As will be appreciated from the foregoing description, through the use of a mutual orthogonality-based layout and configuration of each of its components, the phased array antenna architecture of the present invention is able to integrate a plurality of closely spaced antenna elements of a generally planar spatial array with associated amplifier, phase shift and power divider and distribution networks, in a highly nested physical structure, that enjoys a significantly reduced size and packaging density in contrast to prior art systems.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. An antenna module for a phased array antenna comprising a support member configured to provide connection along a first edge thereof to a plurality of antenna elements, and adapted to be placed in side-by-side relationship with other support members, so that connections for said antenna elements on a plurality of support members may be connected to antenna elements of said phased array antenna;

a double-sided microstrip printed wiring board having a first, underside mounted adjacent to a side of said support member, and having a first plurality of generally parallel microstrip conductors extending in a first direction and being coupled to respective antenna elements from said first edge of said support member, a second, topside, opposite to said first underside, and having a second plurality of generally parallel microstrip conductors extending in a second direction generally orthogonal to said first direction, and conductive vias extending through said double-sided microstrip printed wiring board, and interconnecting said first plurality of microstrip conductors to-connection sites adjacent to said second plurality of generally parallel microstrip conductors; and a plurality of antenna control circuits distributed on said second side of said respective double-sided microstrip printed wiring board, and connected to said connection sites and to said second plurality of generally parallel microstrip conductors.

2. The antenna module according to claim 1, further including a plurality of connector elements provided along a second edge of said support member, coupled to said second plurality of generally parallel microstrip conductors, and being adapted to be coupled to a plurality of signal combiner network modules along second edges of said support members when placed in said side-by-side relationship with other support members.

3. The antenna module according to claim 1, wherein said side of said support member has a plurality of depressions extending in said first direction, and being aligned with and providing shielding for said first plurality of generally parallel microstrip conductors of said double-sided microstrip printed wiring board.

4. The antenna module according to claim 1, wherein said first plurality of generally parallel microstrip conductors of a respective double-sided printed wiring board are connected to conductive pads aligned with signal connection pads of antenna element amplifier modules connected to associated antenna elements, and wherein said first plurality of microstrip conductors contain signal dividers connected by way of said conductive vias to signal distribution connection points disposed along said second plurality of generally parallel microstrip conductors.

5. The antenna module according to claim 4, wherein said second plurality of microstrip conductors are spaced apart by phase shifter module-mounting regions that are sized to accommodate placement of phase shift modules, having terminal pads immediately adjacent to said connection vias and connection locations of said second plurality of microstrip conductors.

6. The antenna module according to claim 5, wherein said second plurality of microstrip conductors have connection pads adjacent to amplifier modules mounted at a front edge of said double-sided printed wiring board, outputs of said amplifier modules being coupled to said connector elements provided along said second edge of support member.

7. The antenna module according to claim 2, wherein a respective signal combiner network module includes signal combiner traces patterned on a printed circuit board connected to associated amplifier modules ported to output terminal connectors therefor.

8. The antenna module according to claim 1, wherein said support member comprises a double-sided, tray-configured support member configured to retain first and second double-sided microstrip printed wiring boards on first and second opposite sides thereof, and having first and second pluralities of antenna elements distributed along said first edge thereof, that are respectively coupled to first pluralities of generally parallel microstrip conductors extending in said first direction on said first and second double-sided microstrip printed wiring boards.

9. The antenna module according to claim 8, wherein said first and second sides of said respective generally tray-configured support member include respective pluralities of depressions extending in said first direction, and being aligned with and providing shielding for said first pluralities of generally parallel microstrip conductors of said first and second double-sided microstrip printed wiring boards.

10. The antenna module according to claim 1, wherein said antenna elements of said phased array are spaced apart from said plurality of support members and are coupled via conductors therefor to said connections for said antenna elements on said plurality of support members.

11. A multi-beam phased array antenna architecture comprising a plurality of generally planar-configured, multi-antenna element coupling and control antenna modules, stacked together in a side-by-side relationship, with mutually adjacent edges thereof containing connections for antenna elements of an antenna array, and wherein opposite, generally tray-configured sides of a respective antenna module contain amplifier modules coupled to said antenna elements, and to first microstrip layers extending in a first direction on undersides of respective double-sided printed wiring boards mounted therewith, outersides of said respective double-sided printed wiring boards containing second microstrip layers extending in a second direction, orthogonal to said first direction, and connected to adjacent phase shift circuit elements, which are further coupled to conductive vias through said respective double-sided printed wiring boards to said first microstrip layers on said undersides thereof, and signal networks, coupled to respective second microstrip layers of said antenna modules, and having ports thereof associated with respective beams of said multi-beam phased array antenna.

12. The multi-beam phased array antenna architecture according to claim 11, wherein said opposite, generally tray-configured sides of said respective antenna module include depressions extending in said first direction, and being aligned with and providing shielding for said first microstrip conductors of said double-sided microstrip support member.

13. The multi-beam phased array antenna architecture according to claim 11, wherein said first microstrip conductors of a respective double-sided support member contain signal distribution elements connected by way of said conductive vias to signal distribution connection points disposed along said second microstrip conductors.

14. The multi-beam phased array antenna architecture according to claim 13, wherein said second microstrip conductors of a respective antenna module are coupled to amplifier circuits adjacent to a front edge of said double-sided support member, and wherein amplifier circuits associated with a respective second microstrip conductor of said plurality of antenna modules are coupled to a respective signal network.

15. The multi-beam phased array antenna architecture according to claim 13, further including a housing that retains said plurality of generally planar-configured, multi-antenna element coupling and control antenna modules stacked together in said side-by-side relationship.

16. The multi-beam phased array antenna architecture according to claim 11, further including a housing that retains said plurality of generally planarcon-figured, multi-antenna element coupling and control antenna modules stacked together in said side-by-side relationship.

17. The multi-beam phased array antenna architecture according to claim 11, wherein said antenna elements of said antenna array are spaced apart from said plurality of generally planar-configured, multi-antenna element coupling and control antenna modules and are coupled via conductors therefor to connections for said antenna elements on said modules.

18. A phased array antenna support architecture comprising:

a plurality of antenna modules supported in side-by-side relationship, a respective antenna module having a plurality of antenna connections distributed along a first edge thereof, so that antenna elements of a spatial array may be connected to said plurality of antenna modules;

a double-sided microstrip support member mounted at a side of a respective module, a first side of a respective microstrip support member having a first plurality of generally parallel microstrip conductors extending in a first direction and being coupled to said antenna elements, and a second side of said respective microstrip support member, opposite to said first side, containing a second plurality of generally parallel microstrip conductors extending in a second direction generally orthogonal to said first direction, and conductive vias extending through said double-sided microstrip support member interconnecting said first plurality of microstrip conductors to connection sites adjacent to said second plurality of generally parallel microstrip conductors on said second side of said respective double-sided microstrip support member;

a plurality of antenna control circuits distributed on said second side of said respective double-sided microstrip support member, and connected to said connection sites and said second plurality of generally parallel microstrip conductors;

a plurality of microstrip connector elements provided along a second edge of a respective antenna module and being coupled to said second plurality of generally parallel microstrip conductors; and a plurality of microstrip signal network modules supported along said second edges of said antenna modules, and containing microstrip signal networks connected to said microstrip connector elements along second edges of said antenna modules, and being provided with external connectors antenna therefor.

19. The phased array antenna support architecture according to claim 18, wherein said side of said respective antenna module includes a plurality of depressions extending in said first direction, and being aligned with and providing shielding for said first plurality of generally parallel microstrip conductors of said double-sided microstrip support member.

20. The phased array antenna support architecture according to claim 18, wherein said depressions contain distributions of support posts for said double-sided microstrip support member.

21. The phased array antenna support architecture according to claim 18, wherein said first plurality of generally parallel microstrip conductors of a respective double-sided support member are connected to conductive pads aligned with signal connection pads of antenna element amplifier modules for connection to associated antenna elements, and wherein said first plurality of microstrip conductors contain signal access points therealong connected by way of said conductive vias to signal connection points disposed along said second plurality of generally parallel microstrip conductors.

22. The phased array antenna support architecture according to claim 20, wherein said second plurality of microstrip conductors are spaced apart by phase shifter module-mounting regions that are sized to accommodate placement of the phase shift modules, having terminal pads immediately adjacent to said connection vias and module connection locations of said second plurality of microstrip conductors.

23. The phased array antenna support architecture according to claim 21, wherein said second plurality of microstrip conductors have connection pads adjacent to amplifier modules mounted at a front edge of said double-sided support member, said amplifier modules being coupled to said connector elements provided along said second edge of a respective antenna module.

24. The phased array antenna support architecture according to claim 22, wherein a respective microstrip signal network module includes microstrip traces patterned on a printed wiring board connected to associated amplifier modules ported to terminal connectors thereof.

25. The phased array antenna support architecture according to claim 18, wherein a respective antenna module comprises a double-sided, tray-configured antenna module configured to retain first and second double-sided microstrip support members on first and second opposite sides thereof, and having first and second pluralities of antenna connection elements distributed along said first edge thereof, that are respectively coupled to first pluralities of generally parallel microstrip conductors extending in said first direction on said first and second double-sided microstrip support members.

26. The phased array antenna support architecture according to claim 22, further including a housing that retains said plurality of generally tray-configured antenna modules in said side-by-side relationship.

27. The phased array antenna support architecture according to claim 25, wherein said first and second sides of said respective generally tray-configured antenna module include respective pluralities of depressions extending in said first direction, and being aligned with and providing shielding for said first pluralities of generally parallel microstrip conductors of said first and second double-sided microstrip support members.

28. The phased array antenna support architecture according to claim 18, wherein said antenna elements of said antenna array are supported in spaced apart relationship from said plurality of antenna modules.

* * * * *

UNITED STATES PATENT AND TRADEMARK OFFICE

CERTIFICATE OF CORRECTION

PATENT NO. : 6,429,816 B1 
DATED : August 6, 2002
INVENTOR(S) : Walter M. Whybrew, Brett A. Pigon, Gary Rief, Gregory M. Jandzio and Jay D. Warshowsky It is certified that error appears in the above-identified patent and that said Letters Patent is hereby corrected as shown below:

Column 3,
Line 28, delete "aconnectors" insert -- connectors --

Column 8,
Line 23, delete "78-6, 78-6" insert -- 78-6, 78-7 --
Line 24, delete "an adjacent" insert -- and adjacent --
Line 62, delete "sections" insert -- section --
Line 63, delete "with wall" insert -- with a wall --

Column 10,
Line 24, delete "to-connection" insert -- to connection --

Column 12,
Line 10, delete "planarcon-figured" insert -- planar-configured --

Signed and Sealed this

First Day of October, 2002

*Attest:*

*Attesting Officer*

JAMES E. ROGAN
*Director of the United States Patent and Trademark Office*